US011474473B2

(12) United States Patent
Furukawa et al.

(10) Patent No.: US 11,474,473 B2
(45) Date of Patent: Oct. 18, 2022

(54) IMAGE FORMING APPARATUS INCLUDING DRUM CARTRIDGE HAVING WASTE TONER ACCUMULATING UNIT IN WHICH WASTE TONER IS ACCUMULATED

(71) Applicant: BROTHER KOGYO KABUSHIKI KAISHA, Nagoya (JP)

(72) Inventors: Masaaki Furukawa, Nagoya (JP); Takashi Shimizu, Nagoya (JP); Shinya Kusuda, Nagoya (JP); Tomitake Aratachi, Toyokawa (JP); Yasuo Fukamachi, Nagoya (JP); Keita Shimizu, Nagoya (JP); Kazutoshi Nakamura, Kuwana (JP); Kouichi Sugimoto, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/478,443

(22) Filed: Sep. 17, 2021

(65) Prior Publication Data

US 2022/0004139 A1 Jan. 6, 2022

Related U.S. Application Data

(63) Continuation of application No. PCT/JP2019/023246, filed on Jun. 12, 2019.

(30) Foreign Application Priority Data

Mar. 27, 2019 (JP) ..... JP2019-059925

(51) Int. Cl.
*G03G 21/12* (2006.01)
*G03G 21/10* (2006.01)
(Continued)

(52) U.S. Cl.
CPC ..... *G03G 21/12* (2013.01); *G03G 21/105* (2013.01); *G03G 21/1676* (2013.01); *G03G 21/1814* (2013.01); *G03G 21/1821* (2013.01)

(58) Field of Classification Search
CPC .. G03G 21/12; G03G 21/105; G03G 21/1676; G03G 21/1814; G03G 21/1821
See application file for complete search history.

(56) References Cited

U.S. PATENT DOCUMENTS 5,398,098 A 3/1995 Fukunaga et al.
2012/0128391 A1 5/2012 Ushikubo
(Continued)

FOREIGN PATENT DOCUMENTS

JP 4-303876 A 10/1992
JP 6-222628 A 8/1994
(Continued)

OTHER PUBLICATIONS

International Search Report and Written Opinion issued in corresponding International Patent Application No. PCT/JP2019/023246, dated Aug. 13, 2019.
(Continued)

*Primary Examiner* — Sandra Brase
(74) *Attorney, Agent, or Firm* — Merchant & Gould P.C.

(57) ABSTRACT

An image forming apparatus includes: a casing having an opening; a developing cartridge configured to accommodate toner therein; and a drum cartridge to which the developing cartridge is attachable. The drum cartridge is attachable to the casing through the opening in a state where the developing cartridge is attached to the drum cartridge. The drum cartridge includes: a photosensitive drum; a drum frame; a charge roller; a cleaning blade configured to clean a circumferential surface of the photosensitive drum; a waste toner collecting unit having an internal space allowing waste toner
(Continued)

removed from the circumferential surface of the photosensitive drum by the cleaning blade to be collected therein; a waste toner accumulating unit having an internal space allowing the waste toner to be accumulated therein; and a waste toner conveying unit configured to convey the waste toner from the waste toner collecting unit to the waste toner accumulating unit.

17 Claims, 6 Drawing Sheets

(51) Int. Cl.
*G03G 21/16* (2006.01)
*G03G 21/18* (2006.01)

(56) References Cited

U.S. PATENT DOCUMENTS

2012/0189345 A1 7/2012 Kim et al.
2015/0050044 A1 2/2015 Sato
2015/0277368 A1 10/2015 Nishiyama et al.
2017/0285567 A1* 10/2017 Fukaya ..... G03G 21/1821
2017/0285568 A1 10/2017 Nishiyama et al.
2018/0267459 A1 9/2018 Sato et al.
2019/0072896 A1* 3/2019 Sato ..... G03G 21/1821

FOREIGN PATENT DOCUMENTS

JP 2012-113006 A 6/2012
JP 2015-36765 A 2/2015
JP 2015-197504 A 11/2015
JP 2017-182013 A 10/2017
JP 2017-182014 A 10/2017
JP 2018-155959 A 10/2018
JP 2018-159755 A 10/2018
JP 2019-45720 A 3/2019

OTHER PUBLICATIONS

International Preliminary Report on Patentability issued in corresponding International Patent Application No. PCT/JP2019/023246, dated Sep. 28, 2021.

* cited by examiner

IMAGE FORMING APPARATUS INCLUDING DRUM CARTRIDGE HAVING WASTE TONER ACCUMULATING UNIT IN WHICH WASTE TONER IS ACCUMULATED

CROSS REFERENCE TO RELATED APPLICATION

This is a by-pass continuation application of International Application No. PCT/JP2019/023246 filed Jun. 12, 2019 claiming priority from Japanese Patent Application No. 2019-059925 filed Mar. 27, 2019. The entire contents of the International Application and the priority application are incorporated herein by reference.

TECHNICAL FIELD

The present disclosure relates to an image forming apparatus and a drum cartridge.

BACKGROUND

Conventionally, there is known an image forming apparatus including a drum cartridge and a developing cartridge. The drum cartridge includes a photosensitive drum, a cleaning blade, and a waste toner conveying unit.

The developing cartridge includes a developing roller, a toner accommodating unit, and a waste toner accumulating unit. The cleaning blade is configured to clean a circumferential surface of the photosensitive drum. The waste toner conveying unit is configured to convey waste toner removed from the circumferential surface of the photosensitive drum by the cleaning blade to the waste tonner accumulating unit. The waste toner conveyed by the waste toner conveying unit is accumulated in the waste toner accumulating unit. Prior art discloses such a conventional image forming apparatus.

SUMMARY

In the conventional image forming apparatus disclosed in the prior art, the developing cartridge includes the toner accommodating unit and the waste toner accumulating unit as described above. Hence, the toner accommodating unit and the waste toner accumulating unit are replaced together when replacement of the developing cartridge with a new developing cartridge is performed.

However, an amount of waste toner generated during image forming operations is smaller than an amount of toner consumed during the image forming operations. Therefore, a timing at which the toner accommodating unit should be replaced may be different from a timing at which the waste toner accumulating unit should be replaced. Accordingly, there is a demand that the toner accommodating unit be replaced independently from the waste toner accumulating unit.

In view of the foregoing, it is an object of the present disclosure to provide an image forming apparatus and a drum cartridge in which a toner accommodating unit and a waste toner accumulating unit can be replaced at different timings, and the waste toner accumulating unit and a photosensitive drum can be replaced at the same timing.

In order to attain the above and other objects, according to one aspect, the present disclosure provides an image forming apparatus including: a casing; a developing cartridge; and a drum cartridge to which the developing cartridge is attachable. The casing has an opening. The developing cartridge includes: a toner accommodating unit; and a developing roller. The toner accommodating unit is configured to accommodate toner therein. The drum cartridge is attachable to the casing through the opening in a state where the developing cartridge is attached to the drum cartridge. The drum cartridge includes: a photosensitive drum; a drum frame to which the developing cartridge is attachable; a charge roller; a cleaning blade; a waste toner collecting unit; a waste toner accumulating unit; and a waste toner conveying unit. The photosensitive drum is rotatable about a first axis extending in a first direction. The developing cartridge is mountable on the drum frame. The charge roller is configured to charge a circumferential surface of the photosensitive drum. The cleaning blade is positioned opposite to the toner accommodating unit with respect to the photosensitive drum in a second direction. The cleaning blade is configured to clean the circumferential surface of the photosensitive drum. The waste toner collecting unit is positioned opposite to the toner accommodating unit with respect to the photosensitive drum in the second direction. The waste toner collecting unit has an internal space allowing waste toner removed from the circumferential surface of the photosensitive drum by the cleaning blade to be collected therein. The waste toner accumulating unit is positioned inside the drum frame and positioned opposite to the waste toner collecting unit with respect to the photosensitive drum in the second direction. The waste toner accumulating unit has an internal space allowing the waste toner to be accumulated therein. The waste toner conveying unit is configured to convey the waste toner from the waste toner collecting unit to the waste toner accumulating unit.

According to another aspect, the present disclosure also provides a drum cartridge including: a photosensitive drum; a drum frame to which a developing cartridge is attachable; a charge roller; a cleaning blade; a waste toner collecting unit; a waste toner accumulating unit; and a waste toner conveying unit. The photosensitive drum is rotatable about a first axis extending in a first direction. The developing cartridge includes a toner accommodating unit accommodating toner therein and a developing roller. The developing cartridge being mountable on the drum frame. The charge roller is configured to charge a circumferential surface of the photosensitive drum. The cleaning blade is positioned opposite to the toner accommodating unit with respect to the photosensitive drum in a second direction. The cleaning blade is configured to clean the circumferential surface of the photosensitive drum. The waste toner collecting unit is positioned opposite to the toner accommodating unit with respect to the photosensitive drum in the second direction. The waste toner collecting unit has an internal space allowing waste toner removed from the circumferential surface of the photosensitive drum by the cleaning blade to be collected therein. The waste toner accumulating unit is positioned inside the drum frame and positioned opposite to the waste toner collecting unit with respect to the photosensitive drum in the second direction. The waste toner accumulating unit has an internal space allowing the waste toner to be accumulated therein. The waste toner conveying unit is configured to convey the waste toner from the waste toner collecting unit to the waste toner accumulating unit.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

<1. Overview of Image Forming Apparatus>

Figure 1:
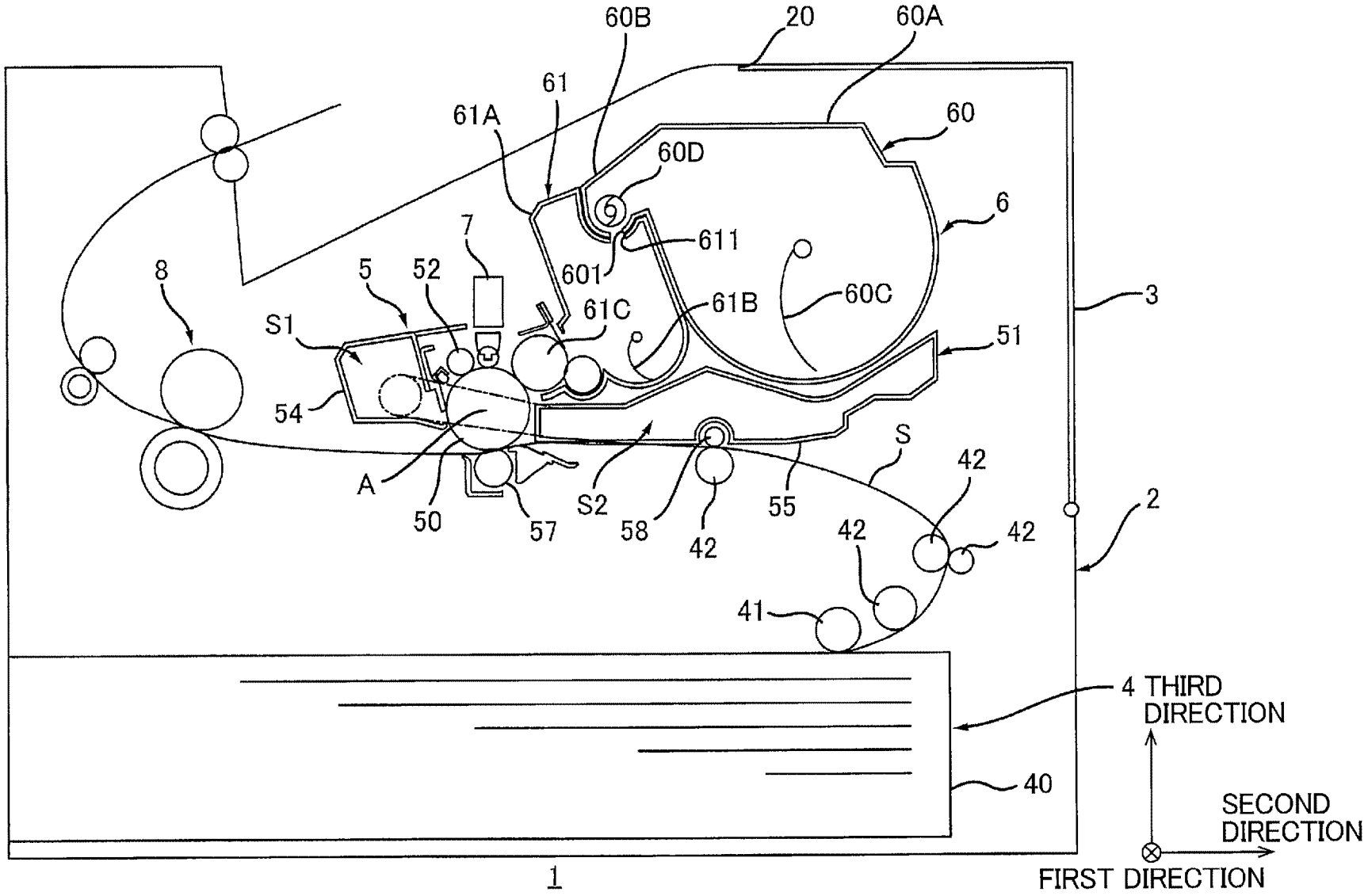
FIG. 1 is a diagram schematically illustrating a configuration of an image forming apparatus according to one embodiment of the present disclosure.

Hereinafter, an image forming apparatus 1 according to one embodiment of the present disclosure will be described while referring to the accompanying drawings.

The image forming apparatus 1 includes a casing 2, a cover 3, a sheet feeding unit 4, a drum cartridge 5, an exposure unit 7, a developing cartridge 6, and a fixing unit 8.

<1.1 Casing 2>

The casing 2 accommodates therein the sheet feeding unit 4, the drum cartridge 5, the developing cartridge 6, the exposure unit 7, and the fixing unit 8. The casing 2 has an opening 20. The opening 20 is positioned opposite to the fixing unit 8 with respect to the drum cartridge 5.

<1.2 Cover 3>

The cover 3 has an open state (see FIG. 3) where the cover 3 closes the opening 20 and a closed state (see FIG. 1) where the cover 3 opens the opening 20.

<1.3 Sheet Feeding Unit 4>

The sheet feeding unit 4 is configured to feed a sheet(s) S to a photosensitive drum 50 (described later). The sheet feeding unit 4 includes a sheet cassette 40, a pick-up roller 41, and a plurality of conveying rollers 42. The sheet cassette 40 accommodates therein a sheet(s) S. The sheet S is, for example, a printing paper. The pick-up roller 41 is configured to pick up the sheet S accommodated in the sheet cassette 40 and to convey the sheet S toward the conveying rollers 42. The conveying rollers 42 are configured to convey the sheet S picked up by the pick-up roller 41 toward the photosensitive drum 50.

<1.4 Drum Cartridge 5>

The drum cartridge 5 includes the photosensitive drum 50, a charge roller 52, and a transfer roller 57.

<1.4.1 Photosensitive Drum 50>

The photosensitive drum 50 is rotatable about a first axis A extending in a first direction. The photosensitive drum 50 extends in the first direction along the first axis A. The photosensitive drum 50 has a hollow cylindrical shape.

<1.4.2 Charge Roller 52>

The charge roller 52 is configured to charge a surface of the photosensitive drum 50. The charge roller 52 is in contact with the surface of the photosensitive drum 50.

<1.4.3 Transfer Roller 57>

The transfer roller 57 is configured to transfer a toner image from the surface of the photosensitive drum 50 to the sheet S. A transfer bias is applied to the transfer roller 57. The transfer roller 57 is in contact with the photosensitive drum 50. The transfer roller 57 is positioned opposite to the charge roller 52 with respect to the photosensitive drum 50.

<1.5 Exposure Unit 7>

The exposure unit 7 is configured to expose the photosensitive drum 50 to light. Specifically, the exposure unit 7 is configured to expose the surface of the photosensitive drum 50 charged by the charge roller 52 to form an electrostatic latent image on the surface of the photosensitive drum 50. The exposure unit 7 is, for example, an LED unit. The exposure unit 7 is positioned between the charge roller 52 and a developing roller 61C (described later).

<1.6 Developing Cartridge 6>

The developing cartridge 6 is attachable to the drum cartridge 5. The developing cartridge 6 includes a toner accommodating unit 60, and a developing unit 61.

<1.6.1 Toner Accommodating Unit 60>

The toner accommodating unit 60 is configured to accommodate therein toner. The toner accommodating unit 60 is attachable to the developing unit 61. The toner accommodating unit 60 is positioned opposite to the photosensitive drum 50 with respect to the developing unit 61. The toner accommodating unit 60 includes a toner casing 60A, a supply unit 60B, an agitator 60C, and an auger screw 60D.

The toner casing 60A is configured to accommodate toner therein. The toner casing 60A has a capacity for accommodating an amount of toner by which the image forming apparatus 1 can perform printing operation on 30,000 sheets S having A4 size.

The supply unit 60B is configured to supply toner in the toner casing 60A to a developing casing 61A of the developing unit 61. The supply unit 60B protrudes from the toner casing 60A. The supply unit 60B is attachable to the developing casing 61A of the developing unit 61. The supply unit 60B has an internal space in communication with an internal space of the toner casing 60A.

The supply unit 60B has a discharge opening 601 allowing toner in the supply unit 60B to be discharged therethrough. The discharge opening 601 is in communication with an inlet opening 611 (described later) of the developing unit 61 in a state where the supply unit 60B is attached to the developing casing 61A. The toner discharged through the discharge opening 601 of the supply unit 60B is introduced into the developing casing 61A through the inlet opening 611.

The agitator 60C is positioned inside the toner accommodating unit 60. Specifically, the agitator 60C is positioned inside the toner casing 60A. The agitator 60C is configured to convey toner in the toner casing 60A toward the supply unit 60B. The agitator 60C is rotatable about an axis extending in the first direction.

The auger screw 60D is positioned inside the supply unit 60B. The auger screw 60D is configured to convey toner in the supply unit 60B toward the discharge opening 601.

<1.6.2 Developing Unit 61>

The developing unit 61 is positioned between the photosensitive drum 50 and the toner accommodating unit 60 in a second direction. The developing unit 61 is configured to supply toner in the toner accommodating unit 60 to the photosensitive drum 50. The developing unit 61 includes the developing casing 61A, a developing agitator 61B, and the developing roller 61C. That is, the developing cartridge 6 includes the developing roller 61C.

The developing casing 61A is configured to accommodate therein toner. Specifically, the developing casing 61A has the inlet opening 611 as described above. The inlet opening 611 allows the toner to be discharged through the discharge opening 601 of the toner accommodating unit 60 to pass therethrough. Accordingly, the toner discharged through the discharge opening 601 of the toner accommodating unit 60 is introduced into the developing casing 61A through the inlet opening 611. The developing casing 61A is configured to accommodate therein the toner received from the toner accommodating unit 60.

The developing agitator 61B is positioned inside the developing casing 61A. The developing agitator 61B is configured to convey the toner in the developing casing 61A toward the developing roller 61C. The developing agitator 61B is rotatable about an axis extending in the first direction.

The developing roller 61C is contactable with the surface of the photosensitive drum 50 and is configured to supply toner to the surface of the photosensitive drum 50. The developing roller 61C supported by the toner casing 60A to be rotatable about an axis extending in the first direction. The developing roller 61C is configured to supply toner in the developing casing 61A to the surface of the photosensitive drum 50, thereby developing the electrostatic latent image formed on the surface of the photosensitive drum 50.

That is, in the developing unit 61, toner supplied from the toner accommodating unit 60 is accommodated in the developing casing 61A, and the toner is supplied to the photosensitive drum 50 by the developing roller 61C. Through this operation, a toner image is formed on the surface of the photosensitive drum 50. The toner image on the surface of the photosensitive drum 50 is transferred by the transfer roller 57 onto the sheet S when the sheet S conveyed from the sheet feeding unit 4 moves through a portion between the photosensitive drum 50 and the transfer roller 57.

<1.7 Fixing Unit 8>

The fixing unit 8 is configured to apply heat and pressure to the sheet S onto which the toner image is transferred to fix the toner image to the sheet S. The sheet S moving past the fixing unit 8 is then discharged on an upper surface of the casing 2.

<2. Details of Drum Cartridge 5>

Figure 2:
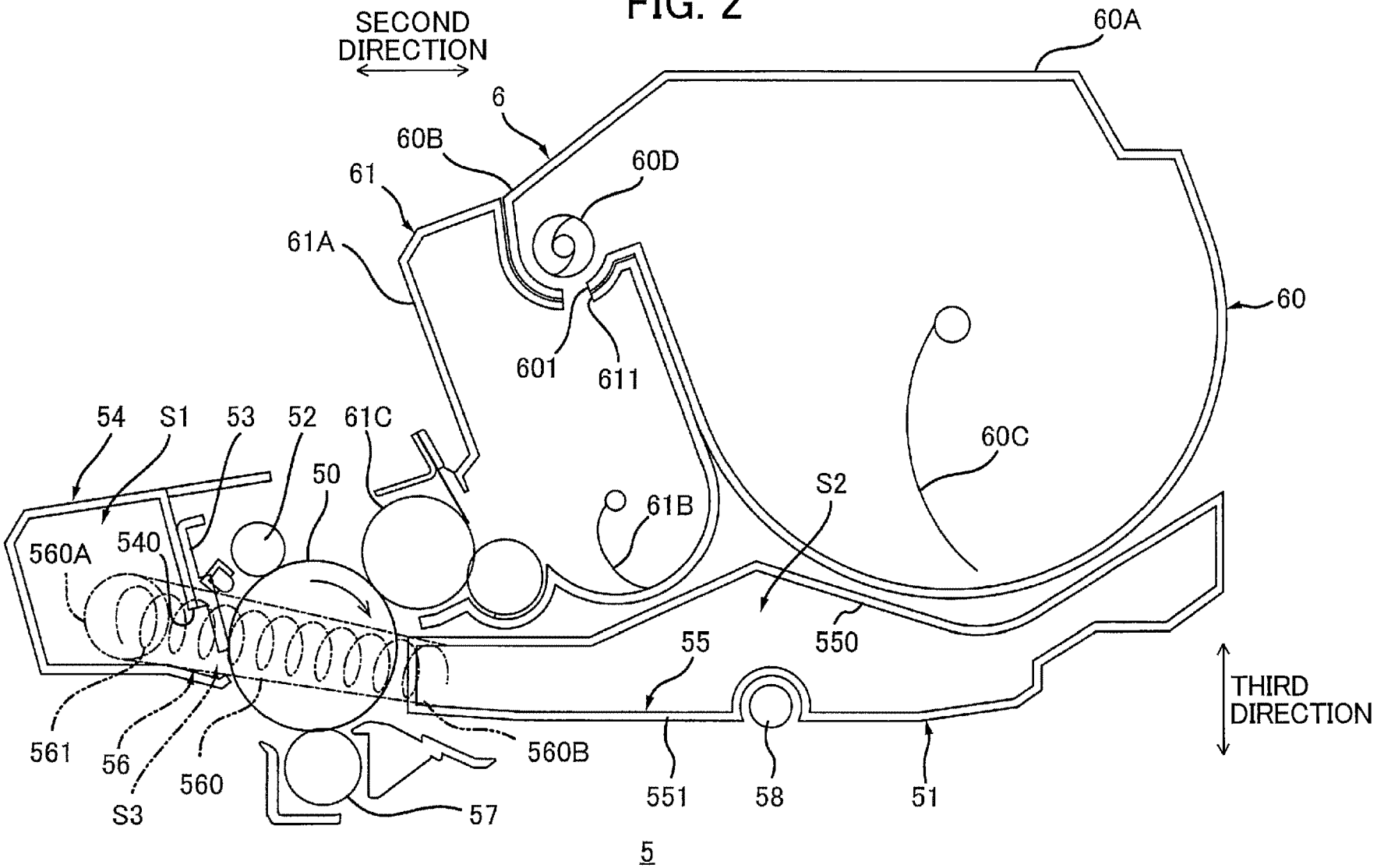
FIG. 2 is a diagram schematically illustrating configurations of a drum cartridge and a developing cartridge in the image forming apparatus according to the embodiment.

Next, details of the drum cartridge 5 will be described with reference to FIG. 2. As illustrated in FIG. 2, the drum cartridge 5 further includes a drum frame 51, a cleaning blade 53, a waste toner collecting unit 54, a waste toner accumulating unit 55, a waste toner conveying unit 56, and a conveying roller 58.

<2.1 Drum Frame 51>

The drum frame 51 is configured to receive the developing cartridge 6. The drum frame 51 allows the developing cartridge 6 to be mounted thereon. The drum frame 51 rotatably supports the photosensitive drum 50. The drum frame 51 rotatably supports the transfer roller 57.

<2.2 Cleaning Blade 53>

The cleaning blade 53 is configured to clean the surface of the photosensitive drum 50. In other words, the cleaning blade 53 makes contact with the surface of the photosensitive drum 50 and is configured to remove waste toner from the surface of the photosensitive drum 50. The cleaning blade 53 is positioned between the transfer roller 57 and the charge roller 52 in a rotational direction of the photosensitive drum 50. The cleaning blade 53 is positioned opposite to the toner accommodating unit 60 with respect to the photosensitive drum 50 in the second direction. The second direction crosses the first direction. Specifically, the second direction is perpendicular to the first direction.

<2.3 Waste Toner Collecting Unit 54>

The waste toner collecting unit 54 has an internal space S1 into which waste toner removed from the surface of the photosensitive drum 50 by the cleaning blade 53 is collected. The waste toner collecting unit 54 is positioned opposite to the toner accommodating unit 60 with respect to the photosensitive drum 50 in the second direction. The waste toner collecting unit 54 supports the cleaning blade 53.

The waste toner collecting unit 54 has an opening 540. The opening 540 is in communication with the internal space S1 of the waste toner collecting unit 54 and allows the waste toner to pass therethrough. The waste toner collecting unit 54 is configured to accommodate therein the waste toner.

<2.4 Waste Toner Accumulating Unit 55>

The waste toner accumulating unit 55 has an internal space S2 in which the waste toner is to be accumulated. The waste toner accumulating unit 55 can accommodate therein waste toner generated during image forming operations performed when the developing cartridge 6 is replaced a plurality of times. Specifically, the waste toner accumulating unit 55 can accommodate therein waste toner when the developing cartridge 6 is replaced three times through five times and image forming operations are performed using the replaced developing cartridge 6.

Further, the waste toner collecting unit 54 and the waste toner accumulating unit 55 can accommodate therein waste toner generated during image forming operations for the durable number of sheets S of the photosensitive drum 50. Specifically, the waste toner collecting unit 54 and the waste toner accumulating unit 55 can accommodate therein waste toner generated due to image forming operations for 100,000 sheets S. Note that a total volume of the waste toner collecting unit 54 and the waste toner accumulating unit 55 falls within a range of from 45% to 60% of a volume of the toner accommodating unit 60.

The waste toner accumulating unit 55 is positioned opposite to the waste toner collecting unit 54 with respect to the photosensitive drum 50 in the second direction. The waste toner accumulating unit 55 is positioned opposite to the waste toner collecting unit 54 with respect to the transfer roller 57 in the second direction. The waste toner accumulating unit 55 is positioned opposite to the waste toner collecting unit 54 with respect to the exposure unit 7 in the second direction (see FIG. 1). That is, the exposure unit 7 is positioned between the waste toner collecting unit 54 and the waste toner accumulating unit 55 in the second direction (see FIG. 1). The waste toner accumulating unit 55 is positioned inside the drum frame 51. The waste toner accumulating unit 55 is a part of the drum frame 51.

The waste toner accumulating unit 55 is positioned downward of the developing cartridge 6. The waste toner accumulating unit 55 extends in the second direction. The waste toner accumulating unit 55 includes a first wall 550 and a second wall 551 with respect to a third direction. The third direction crosses the first direction and the second direction. Specifically, the third direction is perpendicular to the first direction and the second direction. The first wall 550 is contactable with the developing cartridge 6. The second wall 551 is spaced apart from the first wall 550 in the third direction. The second wall 551 is positioned opposite to the developing cartridge 6 with respect to the first wall 550 in the third direction.

<2.5 Waste Toner Conveying Unit 56>

The waste toner conveying unit 56 is configured to convey the waste toner from the waste toner collecting unit 54 to the waste toner accumulating unit 55. The waste toner conveying unit 56 includes a conveying tube 560 and an auger 561. The conveying tube 560 is positioned at one side of the photosensitive drum 50 in the first direction. The photosensitive drum 50 has a first end and a second end in the first direction. The first end of the photosensitive drum 50 is positioned opposite to the conveying tube 560 with respect to the second end of the photosensitive drum 50 in the first direction. The conveying tube 560 is positioned away the second end of the photosensitive drum 50 in the first direction.

The conveying tube 560 extends from the waste toner collecting unit 54 to the waste toner accumulating unit 55 in the second direction, and has a first end 560A and a second end 560B in the second direction. Further, the conveying tube 560 has an internal space S3. Specifically, the first end 560A is positioned away from the second end 560B in the second direction. The first end 560A is connected to the waste toner collecting unit 54 so that the internal space S3 of the conveying tube 560 is in communication with the internal space S1 of the waste toner collecting unit 54, thereby allowing the waste toner in the waste toner collecting unit 54 to be introduced into the conveying tube 560.

Also, the second end 560B is connected to the waste toner accumulating unit 55, and the internal space S3 of the conveying tube 560 is in communication with an internal space S2 of the waste toner accumulating unit 55. With this configuration, the waste toner in the conveying tube 560 can be conveyed to the waste toner accumulating unit 55. The second end 560B is positioned further downward than the first end 560A in a state where the drum cartridge 5 is attached to the casing 2. Accordingly, the waste toner in the conveying tube 560 flows from the first end 560A toward the second end 560B because of the own weight of the waste toner.

The auger 561 is positioned inside the conveying tube 560. The auger 561 is configured to convey the waste toner from the waste toner collecting unit 54 to the waste toner accumulating unit 55.

<2.6 Conveying Roller 58>

The conveying roller 58 is positioned opposite to the waste toner collecting unit 54 with respect to the photosensitive drum 50 in the second direction. The conveying roller 58 is rotatably supported by the drum frame 51. Specifically, the conveying roller 58 is rotatably supported by the second wall 551. The conveying roller 58 makes contact with one of the conveying rollers 42 (see FIG. 1) in the state where the drum cartridge 5 is attached to the casing 2. Accordingly, the conveying roller 58 is configured to feed the sheet S toward the photosensitive drum 50 in cooperation with the one of the conveying rollers 42.

<2.7 Attachment State of Developing Cartridge 6 to Drum Frame 51>

The developing cartridge 6 is attachable to the drum frame 51. The developing cartridge 6 is mounted on the waste toner accumulating unit 55 in a state where the developing cartridge 6 is attached to the drum frame 51. Specifically, the toner accommodating unit 60 and the developing unit 61 make contact with the first wall 550.

Further, in a state where the drum cartridge 5 to which the developing cartridge 6 is attached is attached to the casing 2 (see FIG. 1), a part of the toner accommodating unit 60 is positioned opposite to the waste toner accumulating unit 55 with respect to the exposure unit 7 in the third direction. In other words, an upper end portion of the toner accommodating unit 60 is positioned further upward than the exposure unit 7. Hence, a large volume can be ensured for the toner accommodating unit 60, thereby increasing an amount of the toner accommodated in the toner accommodating unit 60.

<2.8 Attachment of Drum Cartridge 5 and Developing Cartridge 6 to Casing 2>

Figure 3:
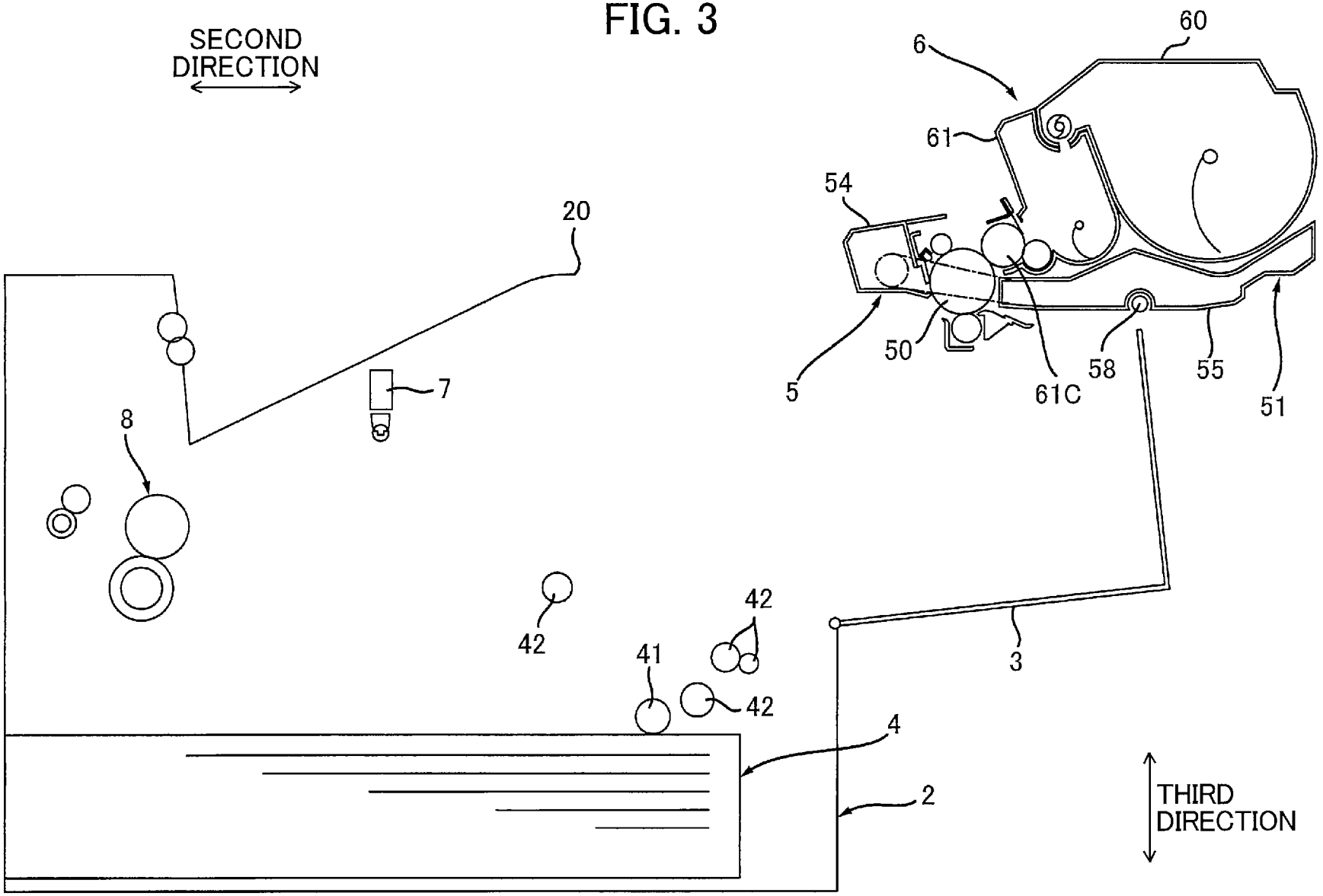
FIG. 3 is an explanatory view for attachment of the drum cartridge to a casing of the image forming apparatus according to the embodiment.

As illustrated in FIG. 3, the drum cartridge 5 to which the developing cartridge 6 is attached is attachable to the casing 2 through the opening 20 in a case where the cover 3 is in the open state. In the present embodiment, the exposure unit 7 is movable between a first position (a position illustrated in FIG. 1) and a second position (a position illustrated in FIG. 3) in interlocking relation to the opening and closing movement of the cover 3.

That is, the exposure unit 7 is positioned at the first position when the cover is in the closed state of the cover 3, whereas the exposure unit 7 is positioned at the second position when the cover 3 is in the open state. The exposure unit 7 at the second position is positioned further upward than the exposure unit at the second position. By virtue of the movement of the exposure unit 7, abutment of the drum cartridge 5 against the exposure unit 7 can be restrained when the drum cartridge 5 is attached to the casing 2.

Figure 4:
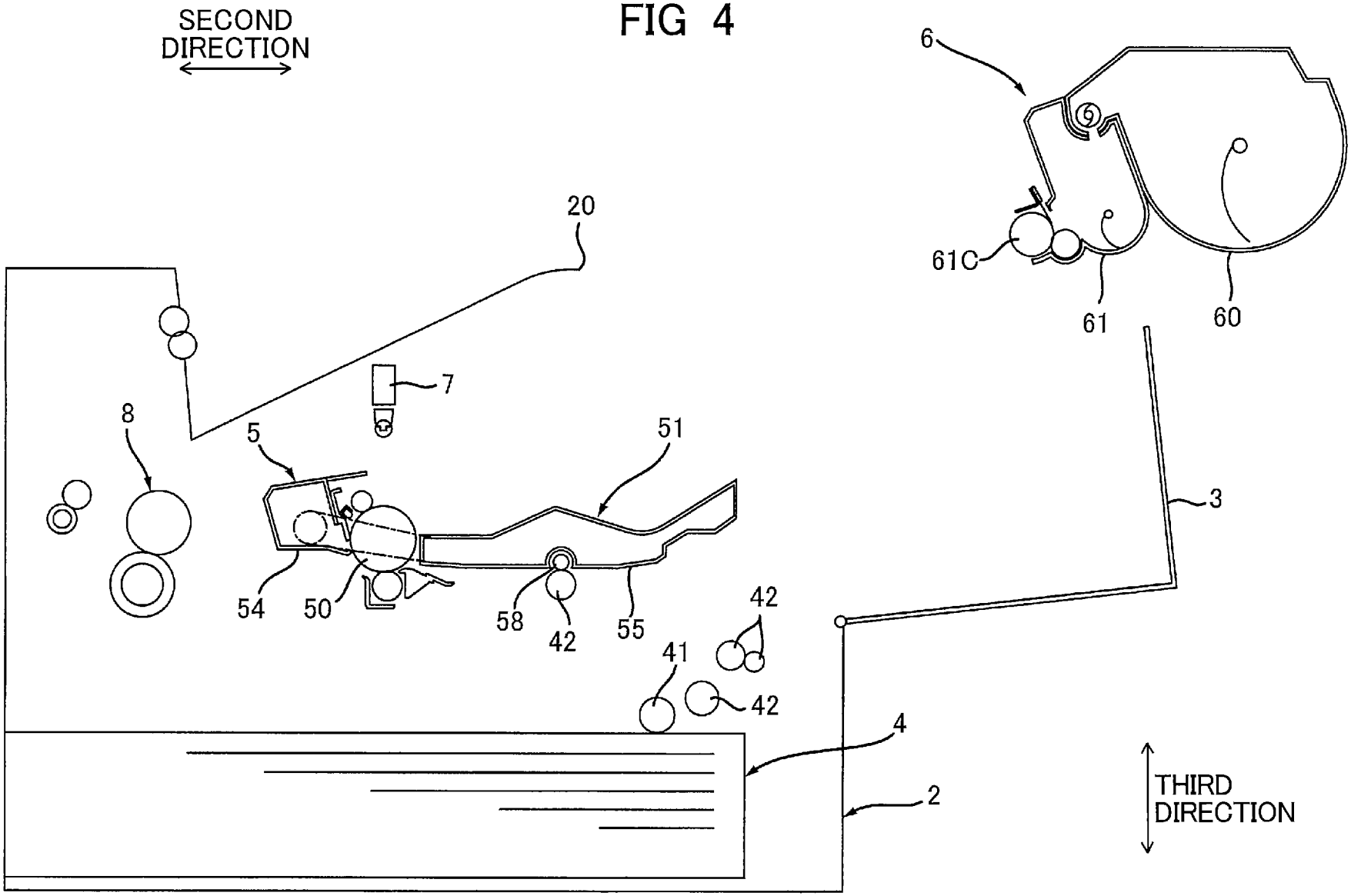
FIG. 4 is an explanatory view for attachment of the developing cartridge to the drum cartridge in the image forming apparatus according to the embodiment.
Figure 5:
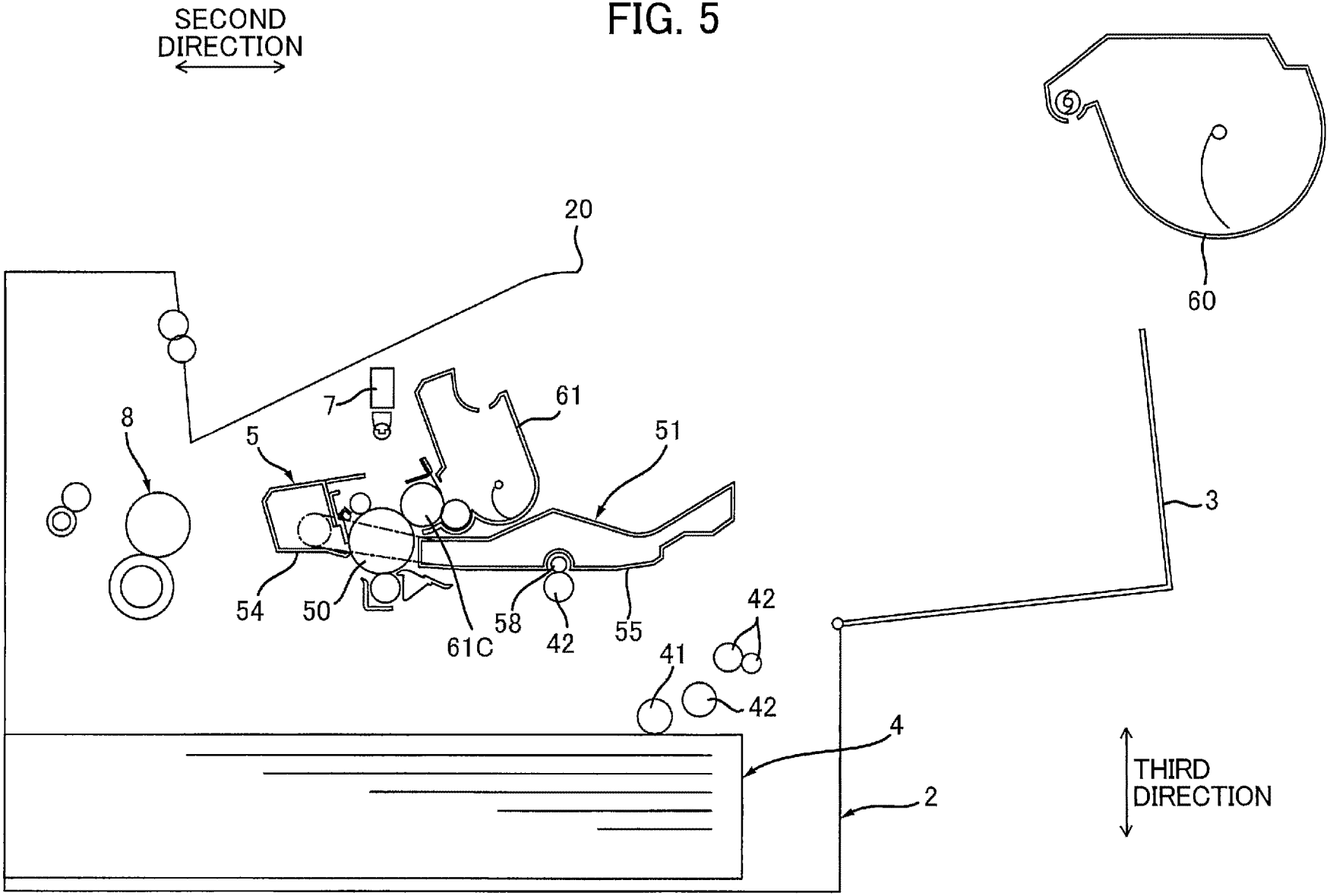
FIG. 5 is an explanatory view for attachment of a toner accommodating unit to a developing unit of the developing cartridge in the image forming apparatus according to the embodiment.

Further, as illustrated in FIG. 4, the developing cartridge 6 is attachable through the opening 20 to the drum frame 51 of the drum cartridge 5 that is attached to the casing 2 in the case where the cover 3 is in the open state. Further, as illustrated in FIG. 5, the toner accommodating unit 60 is attachable through the opening 20 to the developing unit 61 that is attached to the drum frame 51 in the case where the cover 3 is in the open state.

<3. Advantageous Effects>

As illustrated in FIG. 1, in the image forming apparatus 1, the developing cartridge 6 includes the toner accommodating unit 60, and the drum cartridge 5 includes the waste toner accumulating unit 55. Therefore, the toner accommodating unit 60 and the waste toner accumulating unit 55 can be replaced separately from each other. Further, since the waste toner can be collected in the internal space S1 of the waste toner collecting unit 54 and accumulated in the internal space S2 of the waste toner accumulating unit 55, the drum cartridge 5 can accommodate therein waste toner generated until a timing of replacement of the photosensitive drum 50 comes. As a result, the photosensitive drum 50 and the waste toner accumulating unit 55 can be replaced together due to a replacement of the drum cartridge 5.

Further, the waste toner accumulating unit 55 is positioned inside the drum frame 51 on which the developing cartridge 6 can be mounted. Hence, the waste toner accumulating unit 55 can be positioned inside the casing 2 even when the volume of the toner accommodating unit 60 is increased.

<4. Modifications>

While the description has been made in detail with reference to the embodiment, it would be apparent to those skilled in the art that various changes and modifications may be made thereto. Next, first and second modifications to the embodiment will be described with reference to FIGS. 6A and 6B wherein like parts and components are designated by the same reference numerals as those of the depicted embodiment.

Figure 6A:
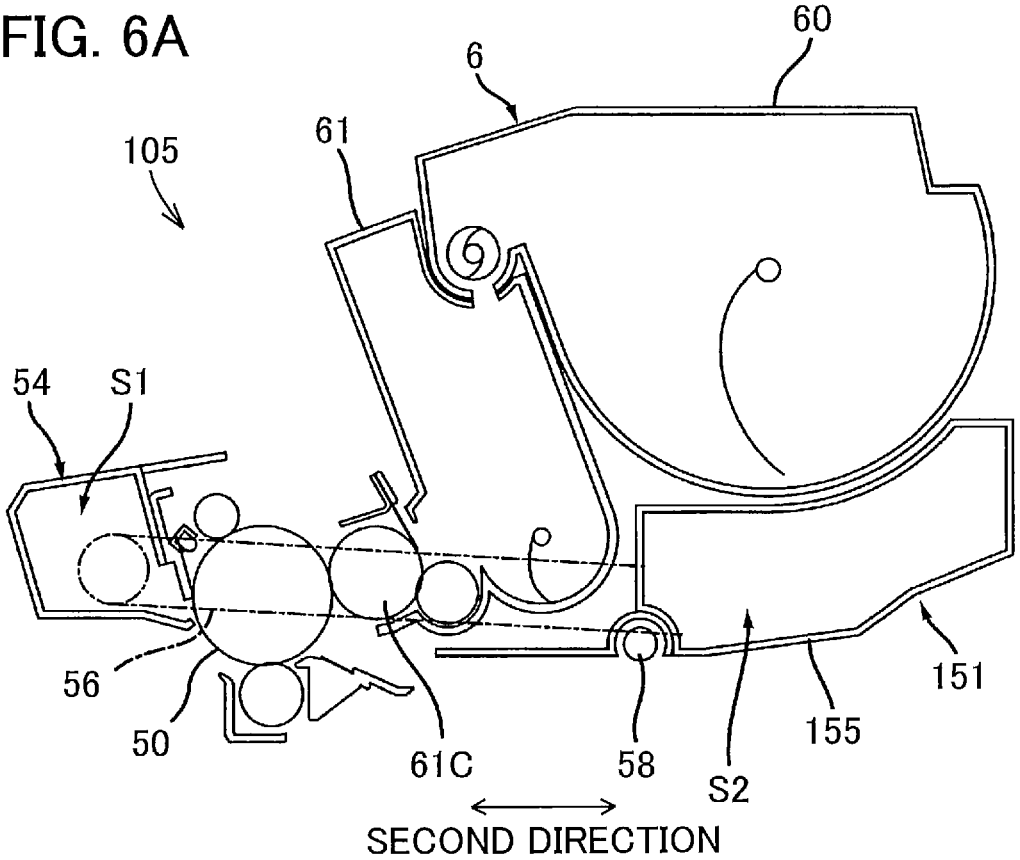
FIG. 6A is a diagram schematically illustrating a configuration of a drum cartridge according to a first modification.

According to the first modification illustrated in FIG. 6A, a drum cartridge 105 includes a drum frame 151 including a waste toner accumulating unit 155 instead of the waste toner accumulating unit 55. The waste toner accumulating unit 155 is positioned opposite to the photosensitive drum 50 with respect to the conveying roller 58 in the second direction. In other words, the waste toner accumulating unit 155 is positioned opposite to the photosensitive drum 50 with respect to the developing unit 61 in the second direction. In this case, the toner accommodating unit 60 is mounted on the waste toner accumulating unit 155 in a state where the developing cartridge 6 is attached to the drum frame 151.

Figure 6B:
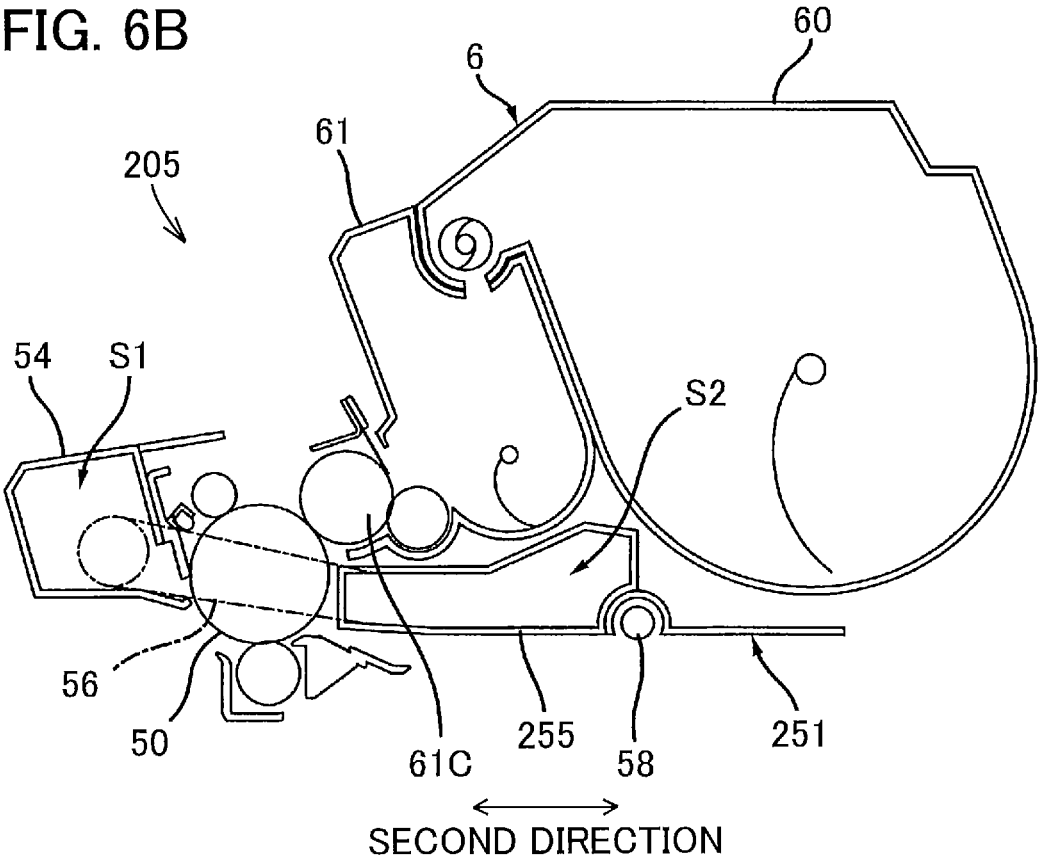
FIG. 6B is a diagram schematically illustrating a configuration of a drum cartridge according to a second modification.

Further, according to the second modification illustrated in FIG. 6B, a drum cartridge 205 includes a drum frame 251 including a waste toner accumulating unit 255 instead of the waste toner accumulating unit 55. The waste toner accumulating unit 255 is positioned between the photosensitive drum 50 and the conveying roller 58 in the second direction. In this case, the developing unit 61 is mounted on the waste toner accumulating unit 255 in a state where the developing cartridge 6 is attached to the drum frame 251.

In the above-described embodiment, the LED unit is used as the exposure unit 7. However, a laser scanning unit can be employed as the exposure unit 7.

Further, the developing unit 61 may be integrally formed with the toner accommodating unit 60. Further, the developing unit 61 may not be partitioned from the toner accommodating unit 60. In this case, the toner accommodating unit 60 may not include the supply unit 60B and the auger screw 60D, but includes only the toner casing 60A and the agitator 60C. Further, in the above case, the internal space of the toner casing 60A is in communication with the internal space of the developing casing 61A.

These modifications can exhibit functions and effects similar to those of the above-described embodiment.

What is claimed is:

1. An image forming apparatus comprising:

a casing having an opening;

a developing cartridge comprising:

a toner accommodating unit configured to accommodate toner therein; and a developing roller; and a drum cartridge to which the developing cartridge is attachable, the drum cartridge being attachable to the casing through the opening in a state where the developing cartridge is attached to the drum cartridge, the drum cartridge comprising:

a photosensitive drum rotatable about a first axis extending in a first direction;

a drum frame to which the developing cartridge is attachable, the developing cartridge being mountable on the drum frame;

a charge roller configured to charge a circumferential surface of the photosensitive drum;

a cleaning blade positioned opposite to the toner accommodating unit with respect to the photosensitive drum in a second direction, the cleaning blade being configured to clean the circumferential surface of the photosensitive drum;

a waste toner collecting unit positioned opposite to the toner accommodating unit with respect to the photosensitive drum in the second direction, the waste toner collecting unit having an internal space allowing waste toner removed from the circumferential surface of the photosensitive drum by the cleaning blade to be collected therein;

a waste toner accumulating unit positioned inside the drum frame and positioned opposite to the waste toner collecting unit with respect to the photosensitive drum in the second direction, the waste toner accumulating unit having an internal space allowing the waste toner to be accumulated therein; and a waste toner conveying unit configured to convey the waste toner from the waste toner collecting unit to the waste toner accumulating unit.

2. The image forming apparatus according to claim 1, wherein the drum cartridge further includes a transfer roller configured to make contact with the photosensitive drum, and wherein the waste toner accumulating unit is positioned opposite to the waste toner collecting unit with respect to the transfer roller in the second direction.

3. The image forming apparatus according to claim 1, wherein the drum cartridge further includes a conveying roller positioned opposite to the waste toner collecting unit with respect to the photosensitive drum in the second direction.

4. The image forming apparatus according to claim 3, wherein the conveying roller is rotatably supported by the drum frame.

5. The image forming apparatus according to claim 3, wherein the wherein the waste toner accumulating unit is positioned between the photosensitive drum and the conveying roller in the second direction.

6. The image forming apparatus according to claim 3, wherein the waste toner accumulating unit is positioned opposite to the photosensitive drum with respect to the conveying roller in the second direction.

7. The image forming apparatus according to claim 1, wherein the second direction crosses the first direction.

8. The image forming apparatus according to claim 1, further comprising an exposure unit configured to expose the photosensitive drum to light, wherein the exposure unit is positioned between the waste toner collecting unit and the waste toner accumulating unit in the second direction.

9. The image forming apparatus according to claim 8, wherein the exposure unit is an LED unit, and wherein a portion of the toner accommodating unit is positioned opposite to the waste toner accumulating unit with respect to the LED unit in a third direction crossing both the first direction and the second direction.

10. The image forming apparatus according to claim 1, wherein the waste toner accumulating unit is configured to accommodate therein waste toner generated by image forming operation performed when the developing cartridge is replaced a plurality of times.

11. A drum cartridge comprising:

a photosensitive drum rotatable about a first axis extending in a first direction;

a drum frame to which a developing cartridge is attachable, the developing cartridge including a toner accommodating unit accommodating toner therein and a developing roller, the developing cartridge being mountable on the drum frame;

a charge roller configured to charge a circumferential surface of the photosensitive drum;

a cleaning blade positioned opposite to the toner accommodating unit with respect to the photosensitive drum in a second direction, the cleaning blade being configured to clean the circumferential surface of the photosensitive drum;

a waste toner collecting unit positioned opposite to the toner accommodating unit with respect to the photosensitive drum in the second direction, the waste toner collecting unit having an internal space allowing waste toner removed from the circumferential surface of the photosensitive drum by the cleaning blade to be collected therein;

a waste toner accumulating unit positioned inside the drum frame and positioned opposite to the waste toner collecting unit with respect to the photosensitive drum in the second direction, the waste toner accumulating unit having an internal space allowing the waste toner to be accumulated therein; and a waste toner conveying unit configured to convey the waste toner from the waste toner collecting unit to the waste toner accumulating unit.

12. The drum cartridge according to claim 11, further comprising a transfer roller configured to make contact with the photosensitive drum, wherein the waste toner accumulating unit is positioned opposite to the waste toner collecting unit with respect to the transfer roller in the second direction.

13. The drum cartridge according to claim 11, further comprising a conveying roller positioned opposite to the waste toner collecting unit with respect to the photosensitive drum in the second direction.

14. The drum cartridge according to claim 13, wherein the conveying roller is rotatably supported by the drum frame.

15. The drum cartridge according to claim 13, wherein the waste toner accumulating unit is positioned between the photosensitive drum and the conveying roller in the second direction.

16. The drum cartridge according to claim 13, wherein the waste toner accumulating unit is positioned opposite to the photosensitive drum with respect to the conveying roller in the second direction.

17. The drum cartridge according to claim 11, wherein the second direction crosses the first direction.

* * * * *